US006209152B1

(12) United States Patent
Kannenberg

(10) Patent No.: US 6,209,152 B1
(45) Date of Patent: Apr. 3, 2001

(54) HEALTH-AND-FITNESS-BRUSH SHOWER INSTALLATION

(76) Inventor: Erich Kannenberg, Theodor-Heuss-Str. 1, D-88677, Markdorf (DE)

( * ) Notice: Subject to any disclaimer, the term of this patent is extended or adjusted under 35 U.S.C. 154(b) by 0 days.

(21) Appl. No.: 09/372,169

(22) Filed: Aug. 20, 1999

(30) Foreign Application Priority Data

Nov. 20, 1998 (DE) ..... 198 53 716

(51) Int. Cl.[7] ..... A47K 7/02
(52) U.S. Cl. ..... 4/606
(58) Field of Search ..... 4/606

(56) References Cited

U.S. PATENT DOCUMENTS 5,870,782 * 2/1999 Kannenberg ..... 4/606

* cited by examiner

*Primary Examiner*—Robert M. Fetsuga
(74) *Attorney, Agent, or Firm*—Bachman & LaPointe, P.C.

(57) ABSTRACT

In the case of a health-and-fitness-brush shower installation with a brush-roller element which is arranged in the region of a wall of a sanitary unit or the like, is assigned rotatably to a drive head and, if appropriate, can have water acting on it. A drive device of the drive head is designed for rechargeable battery operation.

25 Claims, 3 Drawing Sheets

HEALTH-AND-FITNESS-BRUSH SHOWER INSTALLATION

The present invention relates to a health-and-fitness-brush shower installation with a brush-roller element which is arranged in the region of a wall of a sanitary unit or the like, is assigned rotatably to a drive head and, if appropriate, can have water acting on it.

Such a health-and-fitness-brush shower installation is described in DE 196 44 706 A1. You are expressly referred to this document since the present invention constitutes a further development of the health-and-fitness-brush shower installation given therein. It is therefore also possible essentially to dispense with a more detailed description.

Health-and-fitness-brush shower installations serve essentially for all-over body care, in particular in sanitary-unit areas, bathrooms, showers or the like. They aid circulation and promote one's health and can be fitted and used in a straightforward and cost-effective manner. They provide essentially an all-over body massage with different, selectable brushes. It is preferable for wet massages to be carried out, but dry massages are also possible.

The disadvantage with the conventional brush-massage shower installations as are known, for example, from German Patent Application DE 195 10 805 is that high outlay in terms of equipment is necessary in order to set such an installation in operation. In addition, handleability is restricted considerably during use.

The object of the present invention is to provide a health-and-fitness-brush shower installation of the type mentioned in the introduction which is intended to improve the handleability and to increase safety during operation. It is also intended for the production costs to be reduced.

This object is achieved in that a drive device of the drive head is designed for rechargeable battery operation or is driven by pressure activation by means of a water jet.

The drive device, on which the retaining arm is connected, is operated by means of rechargeable energy sources, in particular batteries. This has the advantage that safety during operation is ensured via a low-voltage drive. In particular, the corresponding batteries or energy sources are charged outside operational time, before or after use. As a result, the retaining arm is preferably pivoted onto a wall and can automatically engage in a corresponding contact element in order that the batteries can be charged. It goes without saying that, in this case, safety switches prevent operation of the shower installation.

For this purpose, it has been found to be particularly favorable for the retaining arm to be pivoted onto the wall for charging purposes in order, in this rest position, to release the sanitary unit or the sanitary-unit area, on the one hand, and, on the other hand, to produce a contact with an external energy supply via the contact element.

Even also swinging or inclining the brush-roller element about an axis makes it possible for different areas of use to be better utilized by positive or negative inclination during the massage. This is likewise intended to fall within the scope of the present invention.

Also serving for increasing the handleability is the fact that the brush-roller element is designed such that it can be changed in length in a very straightforward manner, it being possible for two cylinder elements to be moved one inside the other. Said cylinder elements can be drawn apart from one another manually or automatically when desired. In order for a massage to be possible over the entire length in this case, alternating bristle rows engage one inside the other as one cylinder element and the other move one inside the other. These bristle rows may be exchanged as desired. However, other possibilities are also conceivable in order for bristles of different lengths, and if appropriate of a wide range of different types, to be pushed, for example, onto a cylinder element of a brush-roller element. Said bristles may be connected in a rotationally fixed manner to the cylinder element itself or to adjacent bristle elements. This makes the health-and-fitness-brush shower installation overall extremely adaptable to specific applications.

Consequently, the features as described in claims 1 to 3 are also to be considered together, in order to do justice to all the advantages of the health-and-fitness-brush shower installation considered as a whole.

The ability of the brush-roller elements to change length can be improved in that said elements can be subdivided, for example, in the longitudinal and/or transverse direction.

This makes it possible for individual sections to be connected to one another, or released again, along the longitudinal axis in a wide range of different ways in order for an overall length of the brush-roller element to be set. It is also possible here to conceive of a wide range of different connections, latching connections, screw closures or the like in order for two roller elements to be connected to one another in the axial direction. This is intended to fall within the scope of the present invention.

The idea of the present invention is also intended to cover the operation of dividing the brush-roller elements along their longitudinal axis and positioning them, for example, on a shaft. It is also possible to conceive of using brush-roller elements of different lengths in order to have an effect on the overall length of the brush-roller element.

Further advantages, features and details of the invention can be gathered from the following description of preferred exemplary embodiments and with reference to the drawing, in which.

Figure 1:
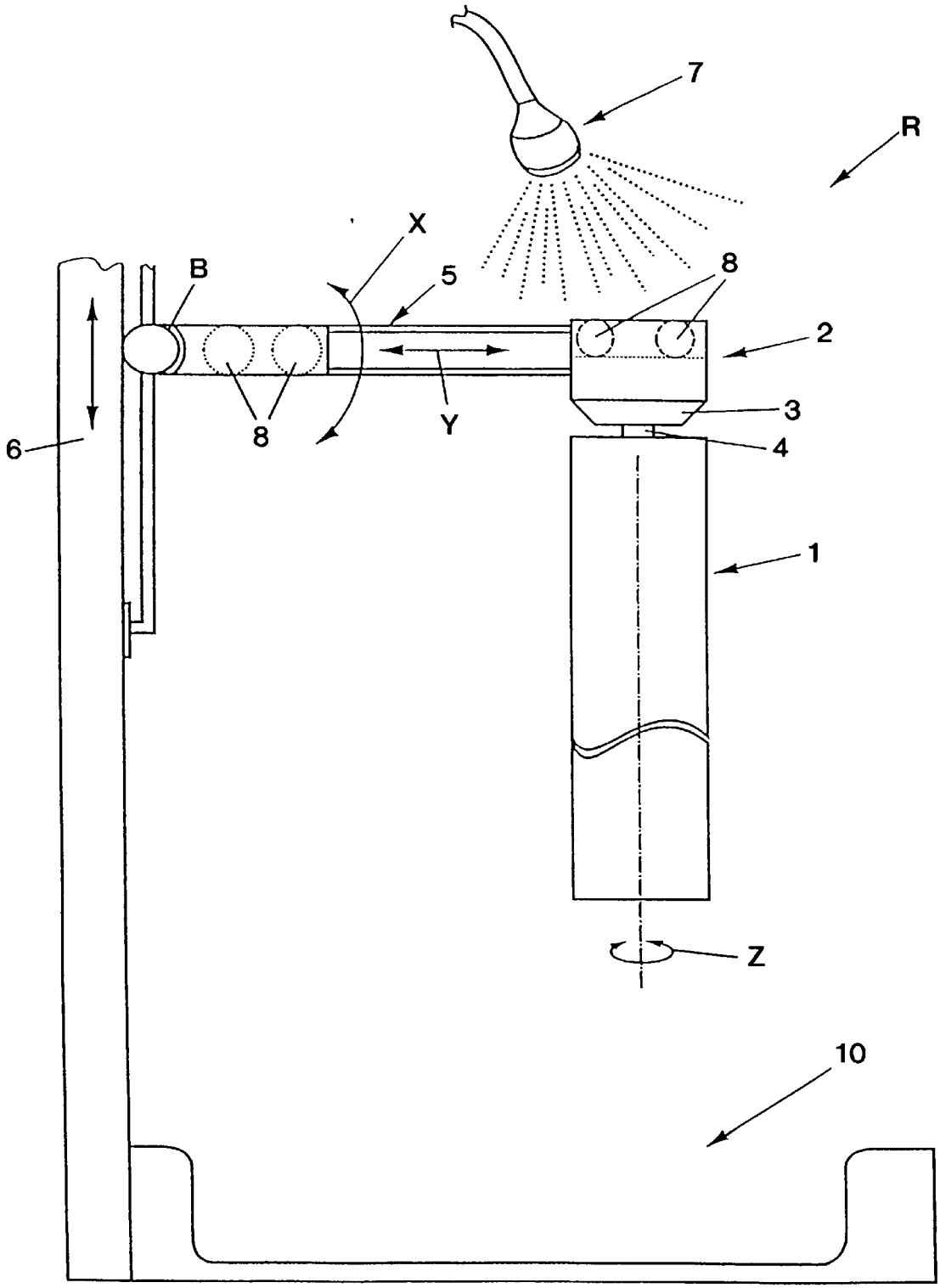
FIG. 1 shows a schematically illustrated side view of a health-and-fitness-brush shower installation according to the invention.

According to FIG. 1, a health-and-fitness-brush shower installation R according to the invention has a brush-roller element 1 which can be moved about an axis of rotation z, preferably approximately vertically, on a drive device 2. The drive device 2 has a drive head 3 on which the brush-roller element 1 is arranged for rotary action via a shaft 4. The drive head 3 may in this case have drive elements (not illustrated specifically), for example electric motors or water-jet-operated drive devices, in order to make the brush-roller element 1 rotate. Use can be made in this case of water jet nozzle drive devices which also at the same time feed to the brush-roller element 1, inside or outside the shaft 4, water which has been heated or brought, for example, to a desired temperature. This is likewise intended to fall within the scope of the present invention. It is thus ensured that, via feedlines (not illustrated here) to the drive device 2, the brush-roller element 1 is made to rotate merely by means of water. This water can be used at the same time for showering. The feed line could be fed to the brush-roller element 1 directly or indirectly via a retaining arm 5, which produces a connection between a wall 6 and the drive device 2. In addition, water may be discharged via a shower head 7 (only illustrated schematically here).

However, the drive head 3 is preferably designed as a battery-operated electric motor, if appropriate with an interposed transmission mechanism. It is possible in this case for a plurality of energy sources 8, as are illustrated by dashed lines, to be inserted either in the drive head 3 itself or else in the retaining arm 5. Furthermore, it has been found to be particularly favorable for the retaining arm 5 to be designed preferably in two parts and such that the latter can be displaced with respect to one another, as in the double arrow direction y illustrated. In this case, the retaining arm 5 may be designed from two elements, in particular cylinder elements, which can be displaced with respect to one another. It is additionally intended to conceive of the retaining arm 5 being adjusted manually or automatically in a stepwise manner, if appropriate by latching. The invention is not limited in any way here.

Figure 2:
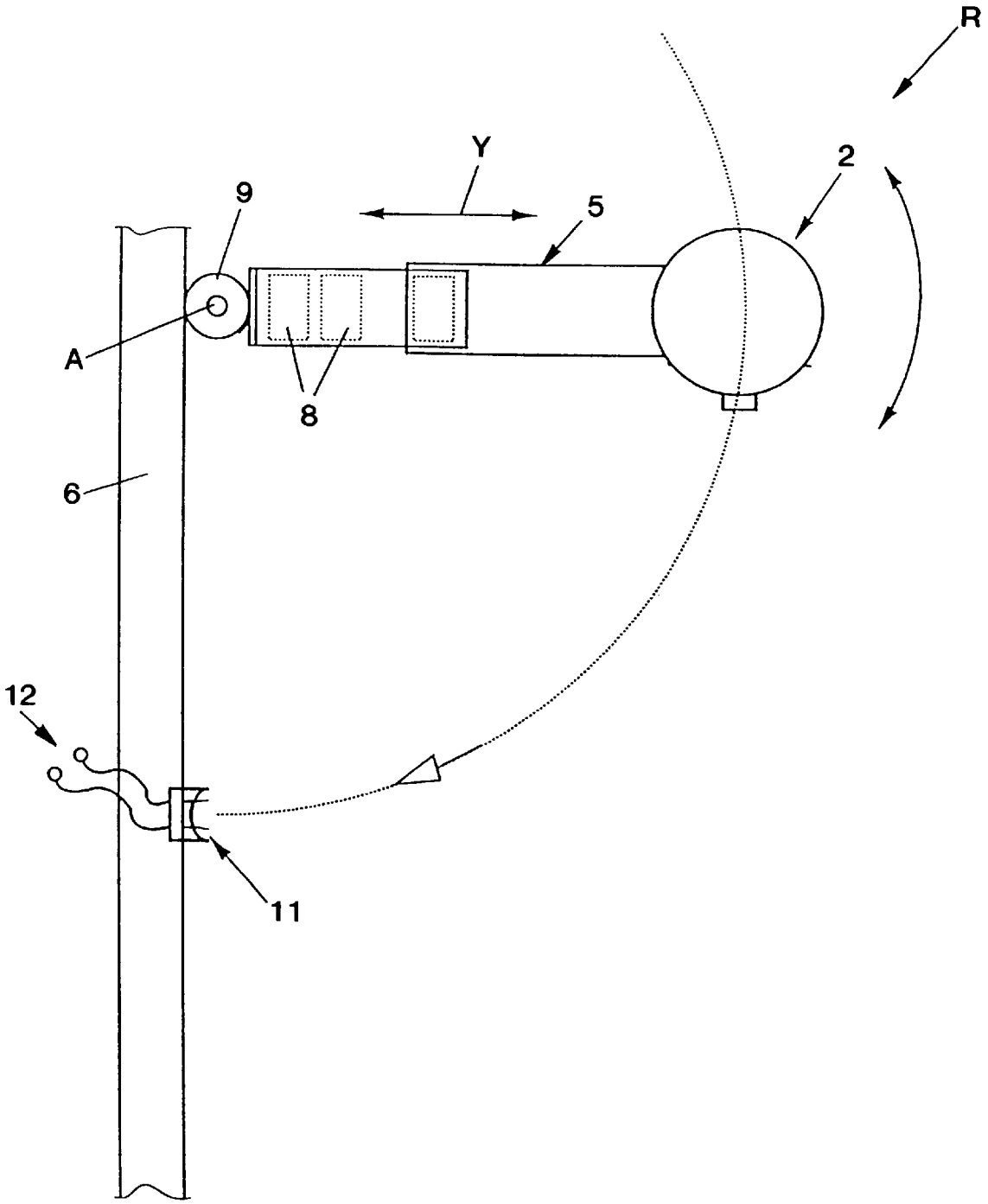
FIG. 2 shows a schematically illustrated plan view of the health-and-fitness-brush shower installation according to FIG. 1.

Furthermore, it is also possible for the retaining arm 5 to be pivoted against the wall 6 in its horizontal position by means of an articulation 9, as is illustrated in particular in FIG. 2, about a spindle A, as indicated in the direction of the double arrow. As a result, the drive device 2 can be pivoted, with the retaining arm 5, laterally out of an area of a sanitary unit 10, see FIG. 1. In this case, the retaining arm 5, in particular the drive device 2, comes into contact with the contact element 11 and produces an electric connection between the drive device 2 and an external energy supply 12. This means that the health-and-fitness-brush shower installation R can be supplied with energy permanently in a rest position, with the result that it is possible for the chargeable energy sources 8, in particular batteries, to be charged.

This has the essential advantage that, during showering, it is not possible for any current to flow from an external energy supply 12 in the sanitary-unit area 10, this considerably increasing safety during operation.

It has also been found to be favorable for the retaining arm 5 to be pivoted about a pivot spindle B, as is illustrated in the direction of the double arrow x, such that it can be secured, in order that the axis of rotation z of the brush-roller element 1 can be inclined positively or negatively. This can provide variation, for example, during showering.

Figure 3:
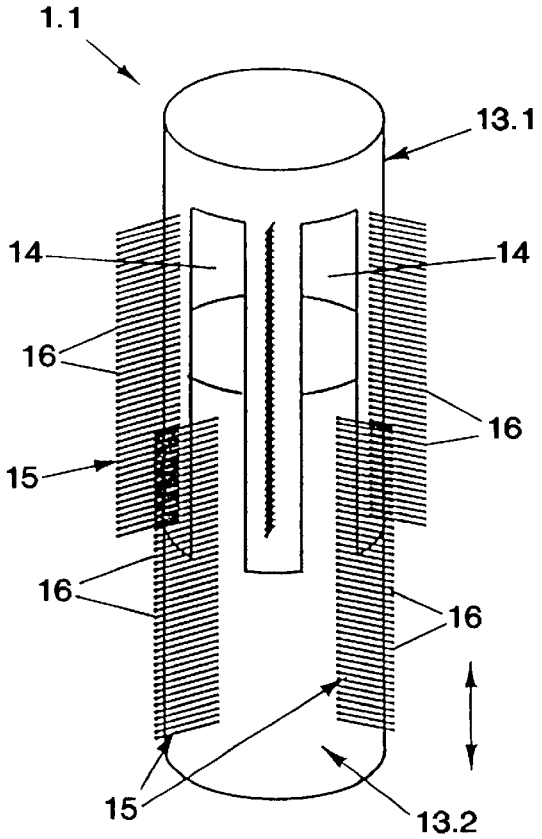
FIG. 3 shows a perspectively illustrated view of a preferred brush-roller element in a use position.

The exemplary embodiment of the present invention according to FIG. 3 shows a preferred brush-roller element 1.1 which comprises two cylinder elements 13.1, 13.2 which can be moved with respect to one another. In this case, the outer cylinder element 13.1 engages over the cylinder element 13.2 at least in part. A plurality of slit-like openings 14 are provided, and correspondingly axially arranged bristle rows 15 of the cylinder element 13.2 engage therein when the cylinder elements are moved with respect to one another. The individual bristle rows 15 comprise a plurality of brushes 16 which may have different lengths and different levels of stiffness.

The bristle rows 15 of the cylinder element 13.2 are preferably arranged such that they alternate with the corresponding bristle rows 15 of the cylinder element 13.1.

In this case, the bristle rows 15 engage in the corresponding openings 14 of the cylinder element 13.1 when the cylinder element 13.2 is moved axially, as illustrated in the direction of the double arrow. It is also conceivable for the individual bristle rows 15 to be positioned on the cylinder elements 13.1, 13.2 such that they can be exchanged and released again, in order for it to be possible for said bristle rows to be exchanged, if appropriate, in a straightforward and cost-effective manner if desired.

Figure 4:
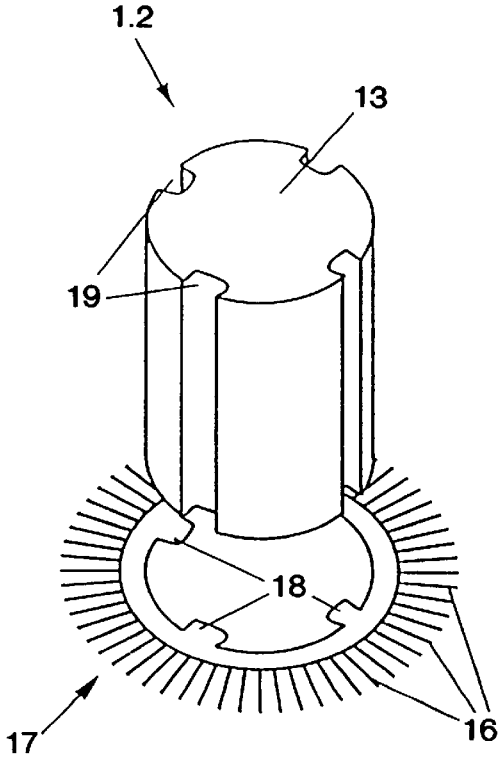
FIG. 4 shows a schematically illustrated perspective view of a possible connection between bristle element and cylinder element.
Figure 5:
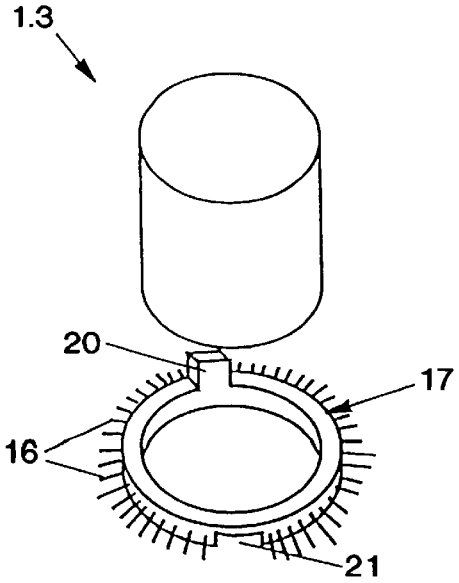
FIG. 5 shows a schematically illustrated perspective view of a further possible way of connecting individual bristle elements to one another on a cylinder element.

FIG. 4 shows a schematically illustrated brush-roller element 1.2, showing the exchangeability of a plurality of bristle elements 17. In this case, the bristle elements 17 are of annular design and are provided inside with at least one latching nose 18. The latching noses 18 engage in corresponding latching grooves 19 of the cylinder element 13. In this case, the bristle elements 17 may be of different thicknesses and lengths (not illustrated specifically here). It is also conceivable for a plurality of bristle elements 17 of, if appropriate, different widths, lengths and thicknesses to be pushed on to the cylinder element 13, it being possible for the brushes 16 to have different lengths, arrangements and levels of stiffness. This makes it possible overall to assemble a brush-roller element 1.2 specifically, with the result that it is also possible for different brushes 16 to be used in different areas. brush-roller element 1.3, in the case of which the bristle element 17 is likewise of annular design, is shown schematically in a last exemplary embodiment of the invention according to FIG. 5. Said bristle element has end-side snap-in elements 20 which engage in fitting recesses 21 of an adjacent bristle element (not illustrated here). This forms a means for preventing individual adjacent bristle elements from rotating with respect to one another. The bristle elements 17 can be produced in the desired lengths in this case.

What is claimed is:

1. A health and fitness brush shower installation, which comprises: a wall; a retaining arm having a first end and a second end spaced from said first end, with said arm connected to said wall via said first end thereof; a drive device connected to said arm at a location spaced from said first end; a drive head connected to said drive device adjacent the second end of said arm; an articulation between the wall and arm, whereby said arm can be pivoted about said articulation with respect to said wall; and a brush-roller element rotatably connected to said drive head; wherein said drive device of the drive head is operative for rechargeable battery operation with at least one rechargeable battery in at least one of said arm, drive device and drive head.

2. An installation according to claim 1, wherein said articulation is a spindle.

3. An installation according to claim 1, wherein said drive device is connected to said arm adjacent said second end.

4. An installation according to claim 1, wherein said brush-roller element includes at least two cylinder elements which are movable with respect to each other and are each provided with a plurality of brushes.

5. An installation according to claim 4, wherein said brushes are arranged on the cylinder elements as bristle rows each running in the axial direction.

6. An installation according to claim 5, wherein said bristle rows are arranged approximately parallel to one another on the cylinder elements.

7. An installation according to claim 5, wherein said bristle rows are arranged alternately on one cylinder element and on the other cylinder element.

8. An installation according to claim 5, wherein at least one cylinder element includes a plurality of slit like openings and wherein the bristle rows of the other cylinder element engage in said slit like openings when said cylinder elements move with respect to each other.

9. An installation according to claim 1, wherein said retaining arm has a changeable length.

10. An installation according to claim 9, wherein said retaining arm includes two parts and wherein said two parts are displaceable with respect to each other.

11. An installation according to claim 1, wherein said brush-roller element includes a plurality of bristle elements axially engaged with at least one cylinder element.

12. An installation according to claim 11, wherein the bristle elements are affixed to an annular member which removably engages said cylinder element.

13. An installation according to claim 12, wherein the annular member includes at least one latching nose which engages in at least one corresponding latching groove of the cylinder element.

14. An installation according to claim 12, wherein the annular member engages said cylinder element in a fixed relationship.

15. An installation according to claim 12, wherein said annular member includes a fitting recess for receiving an adjacent annular member including bristles thereon.

16. An installation according to claim 1, wherein said rechargeable battery is located in at least one said arm and said drive head.

17. An installation according to claim 1, including means on said installation for recharging said rechargeable battery.

18. An installation according to claim 17, wherein said means for recharging is located on said wall and wherein said arm is pivotably mounted such that it can be pivoted into engagement with said means for recharging said rechargeable battery.

19. An installation according to claim 1, wherein the drive head is operated electrically by said rechargeable battery.

20. An installation according to claim 1, including means for supplying water to said brush-roller element.

21. An installation according to claim 1, including means for dividing said brush-roller element in at least one of its longitudinal and transverse direction.

22. An installation according to claim 21, wherein said means for dividing is operative to adjust the overall length of the brush-roller element.

23. An installation according to claim 16, including at least two of said rechargeable batteries in said arm.

24. An installation according to claim 4, wherein one of said cylinder elements engages over the other of said cylinder elements.

25. An installation according to claim 21, wherein said means for dividing divides said brush-roller element approximately in half.

* * * * *